US007673480B2

(12) United States Patent
Hygema

(10) Patent No.: US 7,673,480 B2
(45) Date of Patent: Mar. 9, 2010

(54) MOUNTING AND METHOD FOR MOUNTING A WATER VACUUM BREAK

(75) Inventor: Terry L. Hygema, Greer, SC (US)

(73) Assignee: Group Dekko, Inc., Kendallville, IN (US)

( * ) Notice: Subject to any disclaimer, the term of this patent is extended or adjusted under 35 U.S.C. 154(b) by 935 days.

(21) Appl. No.: 11/430,320

(22) Filed: May 9, 2006

(65) Prior Publication Data

US 2006/0254322 A1 Nov. 16, 2006

Related U.S. Application Data

(60) Provisional application No. 60/679,527, filed on May 10, 2005.

(51) Int. Cl.
*D06F 39/08* (2006.01)

(52) U.S. Cl. ..... 68/207

(58) Field of Classification Search ..... 68/207; 134/198

See application file for complete search history.

(56) References Cited

U.S. PATENT DOCUMENTS

| | | | | | |
|---|---|---|---|---|---|
| 2,417,908 | A | * | 3/1947 | Bowen | 68/58 |
| 2,502,211 | A | | 3/1950 | Dyer | 137/21 |
| 2,687,633 | A | | 8/1954 | Sharp et al. | 68/23 |
| 2,734,369 | A | * | 2/1956 | Simonaitis | 68/207 |
| 3,020,741 | A | * | 2/1962 | Waldrop | 68/23.5 |
| 3,508,571 | A | | 4/1970 | Dutcher et al. | 137/216 |
| 3,566,906 | A | * | 3/1971 | Beare | 137/216 |
| 3,821,961 | A | | 7/1974 | Schimke | 134/182 |
| 4,657,036 | A | | 4/1987 | Yake | 134/95 |
| 4,754,622 | A | * | 7/1988 | Fanson | 68/207 |
| 4,988,149 | A | | 1/1991 | Mulder et al. | 312/233 |
| 5,031,426 | A | * | 7/1991 | Wilson | 68/207 |
| 5,251,939 | A | * | 10/1993 | Jordan | 285/24 |
| 5,782,112 | A | * | 7/1998 | White et al. | 68/207 |
| 6,185,774 | B1 | | 2/2001 | Tubman | 8/158 |
| 6,349,731 | B1 | | 2/2002 | Schaaf et al. | 134/114 |

FOREIGN PATENT DOCUMENTS

| | | | |
|---|---|---|---|
| DE | 36 29 636 | * | 3/1988 |

* cited by examiner

*Primary Examiner*—Frankie L Stinson
(74) *Attorney, Agent, or Firm*—Taylor & Aust, P.C.

(57) ABSTRACT

A washing machine including a water tub, a housing and a water vacuum break. The water tub is mounted in the housing. The housing includes an outer wall having a plurality of slots therein. The water vacuum break partially extends over a portion of the water tub. The vacuum break includes at least one retaining protrusion and at least one retaining snap associated with the at least one retaining protrusion. The at least one retaining protrusion extends over a portion of the outer wall and the at least one retaining snap has an edge that engages a portion of one of the plurality of slots.

11 Claims, 5 Drawing Sheets

MOUNTING AND METHOD FOR MOUNTING A WATER VACUUM BREAK

CROSS REFERENCE TO RELATED APPLICATIONS

This is a non-provisional application based upon U.S. provisional patent application Ser. No. 60/679,527, entitled "MOUNTING METHOD FOR WATER VACUUM BREAK", filed May 10, 2005.

BACKGROUND OF THE INVENTION

1. Field of the Invention

The present invention relates to a water vacuum break, and, more particularly, to a water vacuum break utilized in a washing machine.

2. Description of the Related Art

Water inlet devices are used to provide a vacuum break in the inlet water supply that disperses water from an inlet supply hose into the tub of a washing machine. The water is directed to a load of clothes, which are located in the bottom of the tub or along the sidewall of the tub.

The typical automatic clothes washer or dishwasher for home use is equipped to carry on a series of operations in sequence. The series of operation is most commonly referred to as a cycle. A typical cycle includes fill and rinse elements, each of which utilize a water inlet device, such as a vacuum break, to supply water to the washer. A washing machine includes a housing in which the mechanical operating devices are mounted. It is typical to include a motor assembly for causing motion within the washing device and water control valves for turning on the hot and cold water as necessary under the control of a controller. The water control valves may be associated with the water vacuum break The desirability of a vacuum break prevents water from re-entering the water supply source, thereby preventing the contamination of the water source.

What is needed in the art is a simple cost effective way of mounting a vacuum water break for the easy installation and removal thereof.

SUMMARY OF THE INVENTION

The present invention relates to a water vacuum break installed in a washing machine without the need for tools or separate fasteners.

The invention comprises, in one form thereof, a washing machine including a water tub, a housing and a water vacuum break. The water tub is mounted in the housing. The housing includes an outer wall having a plurality of slots therein. The water vacuum break partially extends over a portion of the water tub. The vacuum break includes at least one retaining protrusion and at least one retaining snap associated with the at least one retaining protrusion. The at least one retaining protrusion extends over a portion of the outer wall and the at least one retaining snap has an edge that engages a portion of one of the plurality of slots.

An advantage of the present invention is that the water vacuum break is easily installable without the use of tools.

Another advantage of the present invention is that the water vacuum break can be removed by depressing retaining snaps without the use of a tool.

Another advantage of the present invention is that at least one of the retaining snaps is further retained by another portion of the washing machine to prevent incidental removal of the water vacuum break.

Yet another advantage of the present invention is that the water vacuum break is installed in a series of slots by approaching the slots in an orthogonal direction and then once the retaining protrusions extend therethrough moving the water vacuum break in a direction parallel with the wall having the slots therein.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
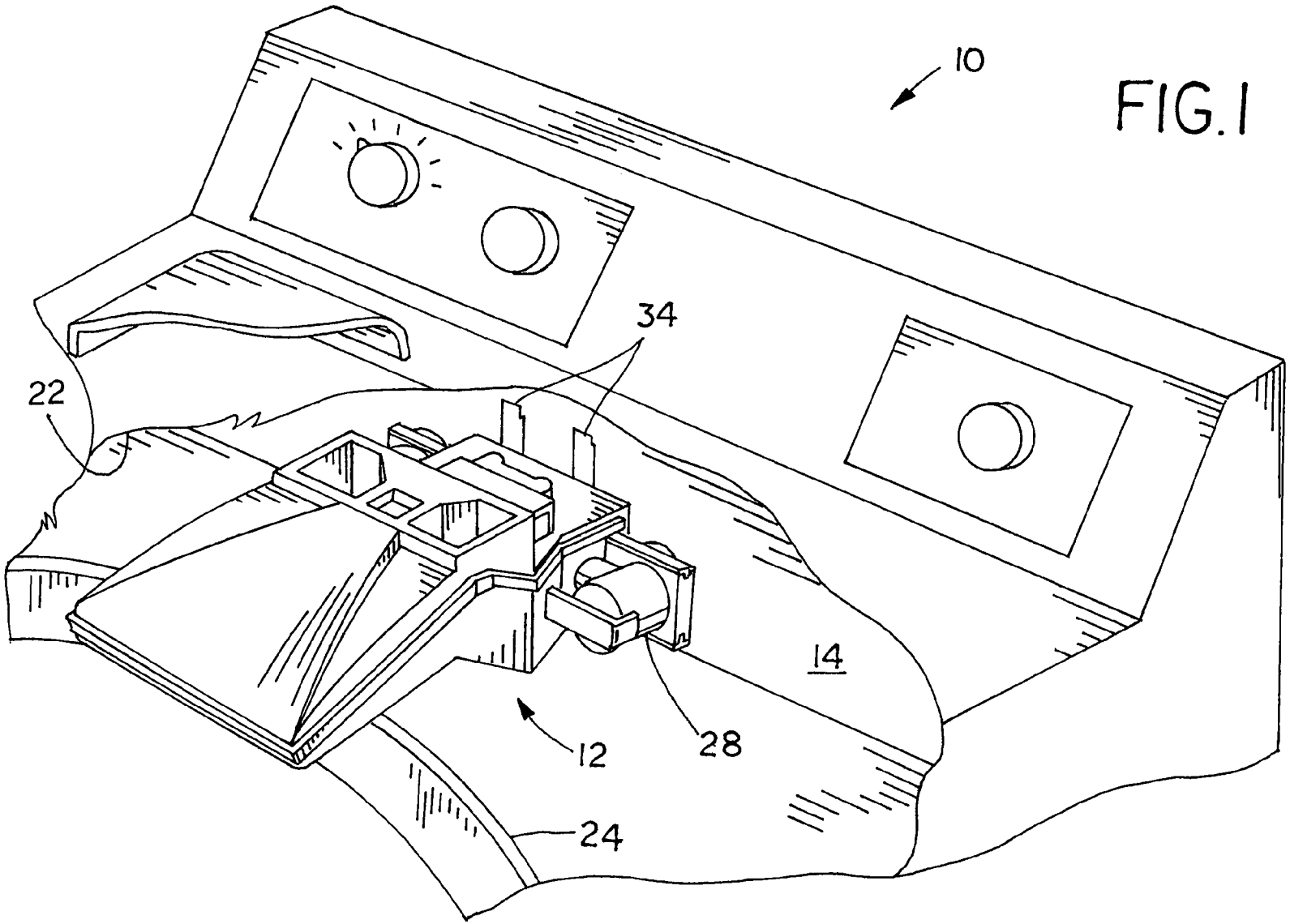
FIG. 1 is a perspective view of a washing machine showing one embodiment of a water vacuum break of the present invention.
Figure 2:
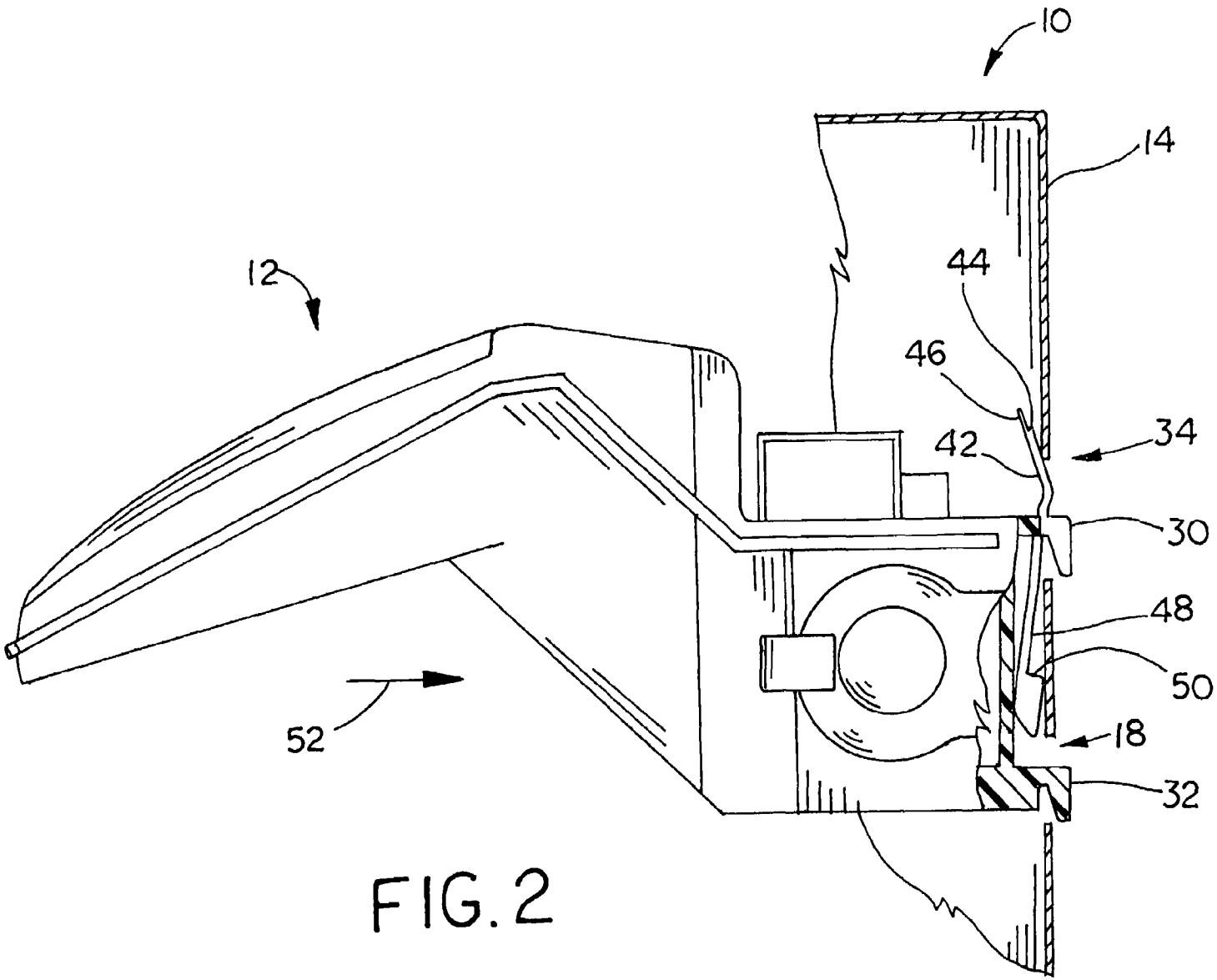
FIG. 2 is a partial cross-sectional view of the washing machine of FIG. 1 illustrating the water vacuum break of FIG. 1 being inserted into a portion of the washing machine.
Figure 3:
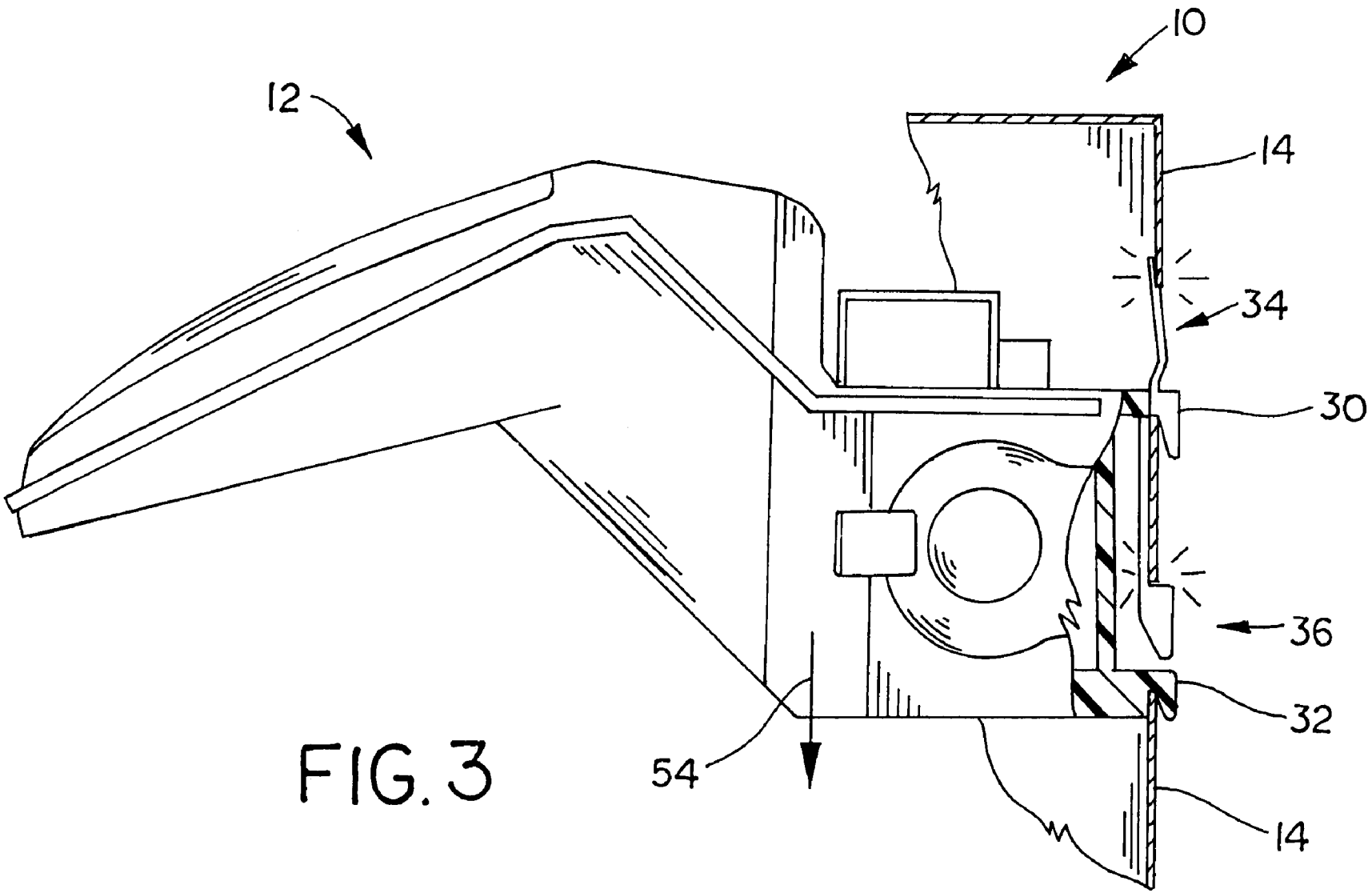
FIG. 3 is another partial cross-sectional view showing the water vacuum break of FIGS. 1 and 2 being slid into a retained position.
Figure 4:
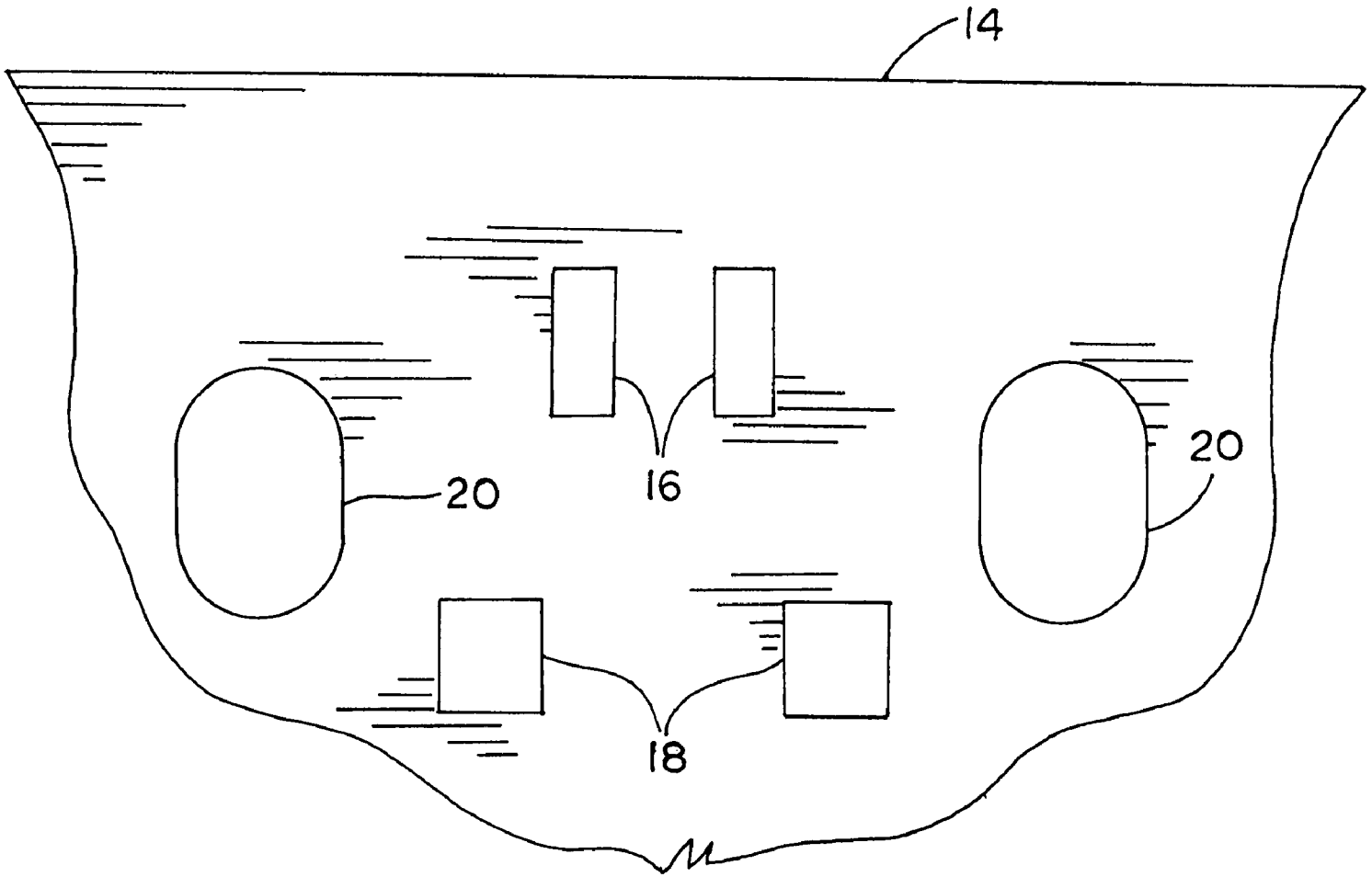
FIG. 4 is a view of slots in the washing machine of FIGS. 1-3 illustrating slots in an outer wall to accommodate the water vacuum break of the present invention.
Figure 5:
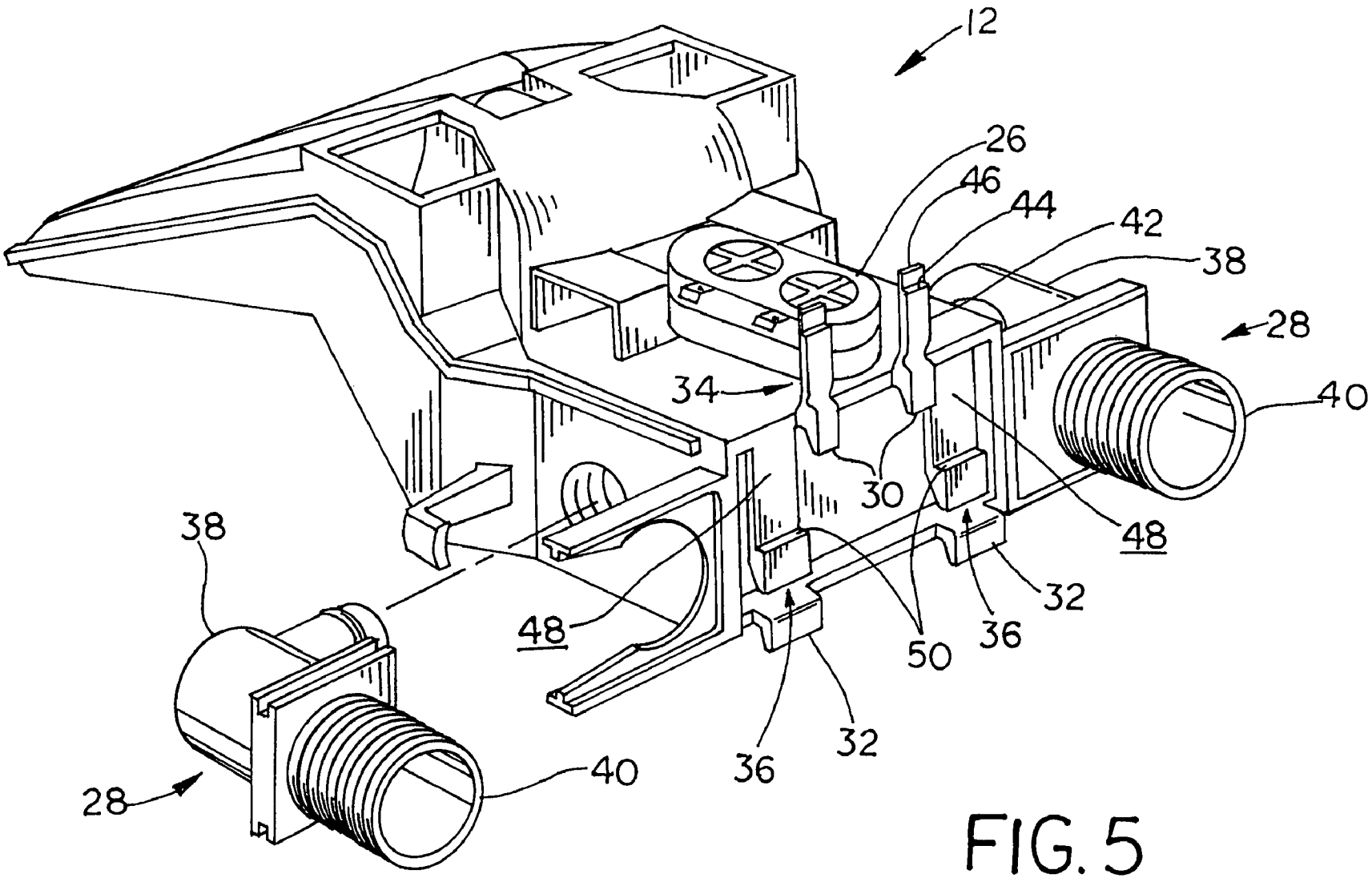
FIG. 5 is a perspective view of the water vacuum break of FIGS. 1-3 showing connection features thereof.

Referring now to the drawings, and more particularly to FIG. 1, there is shown a washing machine 10 including a water vacuum break assembly 12 connected to washing machine 10. Washing machine 10 includes a housing 14 with an exterior wall of metal construct.

Now, additionally referring to FIGS. 2-5, housing 14 has a series of slots therein including upper mounting slots 16, lower mounting slots 18 and elongated curved openings 20. Slots 16 and 18 interact with connection features of vacuum break assembly 12 discussed hereinafter. Elongated curved openings 20 accommodate the insertion and sliding of hose connectors that are part of water vacuum break assembly 12. Within housing 14 there are various constraints within washing machine 10 including a top constraint 22, which may be a top portion of washing machine 10. Further the positioning of tub 24 serves as a constraint for the positioning of water vacuum break assembly 12. Water vacuum break assembly 12 supplies water to tub 24 during the operation of washing machine 10.

Water vacuum break assembly 12 includes thermal sensor assembly 26, valve assemblies 28, upper grooved lips 30, lower grooved lips 32, upper retaining snaps 34, and lower retaining snaps 36. Thermal sensor assembly 26 is associated with water vacuum break assembly 12 to sense the temperature of the water passing through water vacuum break assembly 12 and the information from the sensor is sent to a controller that then provides control signals to valve assemblies 28 to control the volume and temperature of the water flowing through water vacuum break assembly 12.

Valve assemblies 28, are associated with water vacuum break assembly 12 although they can be separate located. Valve assembly 28 is located at each side of 12 and is snapped into position, one for the supplying of cold water and the other for the supplying of hot water. Valve assemblies 28 include a solenoid 38 and a hose connector 40. Solenoid 38 is electrically connected to a controller, which activates solenoid 38 at appropriate times. Hose connector 40 extends through elongated curved opening 20 when water vacuum break assembly 12 is inserted through housing 14 in direction 52 and then once inserted water vacuum break assembly 12 is moved in direction 54. Direction 52 is substantially orthogonal with the exterior wall of housing 14 and direction 54 is substantially parallel with the exterior wall of housing 14.

Grooved lips 30 and 32 are L-shaped protrusions that extend generally outwardly and downwardly from the back portion of water vacuum break assembly 12. Lips 30 and 32 are arranged so that they will extend through slots 16 and 18, respectively, and then slide over an outer portion of the exterior wall of housing 14. When grooved lips 30 and 32 are pushed into position through slots 16 and 18, and then downwardly, retaining snaps 34 and 36 snap into position to hold water vacuum break assembly 12 in a fixed position relative to the exterior wall of housing 14.

Upper retaining snaps 34 include a flexible arm 42, a retaining edge 44 and a retaining extension 46. Flexible arm 42 is molded from the same material as the bulk of water vacuum break assembly 12 and is shaped and formed to take advantage of the flexible nature of a reduced cross-sectional area of the material. Retaining edge 44 is positioned relative to the bottom of grooved lip 30 so that when grooved lip 30 is fully inserted and extends over a portion of the exterior wall of housing 14 that retaining edge 44 snaps into position within an upper mounting slot 16. Retaining extension 46 serves to not allow retaining edge 44 to extend too far through slot 16 and to additionally allow another portion of washing machine 10, not shown, to be mounted after water vacuum break assembly 12 to thereby prevent incidental disconnection of water vacuum break assembly 12 from washing machine 10. In a similar manner lower retaining snaps 36 include a flexible arm 48 and a retaining edge 50. Flexible arm 48 serves a dual purpose to allow the flexing of snap 36 and also prevents retaining edge 50 from extending too far through slot 18. As with retaining snap 34, retaining snap 36 is shaped and positioned such that when grooved lip 32 is in position retaining edge 50 engages an edge of slot 18 to prevent the removal of vacuum break assembly 12 from the exterior wall of housing 14.

The insertion of water vacuum break assembly 12 includes moving assembly 12 in first direction 52 until grooved lips 30 and 32 extend, respectively through slots 16 and 18. At this point in the operation snaps 34 and 36 are flexed away from their normal position until water vacuum break assembly 12 is moved in second direction 54 thereby allowing flexible arms 42 and 48 to return to their normal position thereby causing retaining edges 44 and 50 to engage upper portions of slots 16 and 18, respectively. In this position hose connectors 40 extend through the exterior wall of housing 14 allowing the connection of the water hose to each hose connector 40.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A washing machine, comprising:

a water tub;

a housing, said water tub mounted therein, said housing including an outer wall having a plurality of slots therein; and a water vacuum break partially extending over a portion of said water tub, said water vacuum break including:

at least one retaining protrusion; and at least one retaining snap associated with said at least one retaining protrusion, such that said at least one retaining protrusion extends over a portion of said outer wall and said at least one retaining snap has an edge that engages a portion of one of said plurality of slots, said at least one retaining protrusion being L-shaped extending from a surface of said water vacuum break, said at least one retaining protrusion and said at least one retaining snap associated with said at least one retaining protrusion both utilize one of said plurality of slots, said at least one retaining protrusion including a first retaining protrusion and a second retaining protrusion and said at least one retaining snap including a first retaining snap and a second retaining snap, said first retaining protrusion and said first retaining snap associated with each other and said second retaining protrusion and said second retaining snap associated with each other, said plurality of slots including a first slot and a second slot, said first retaining protrusion and said first retaining snap being associated with said first slot and said second retaining protrusion and said second retaining snap associated with said second slot.

2. The washing machine of claim 1, wherein said at least one retaining snap includes a flexible arm associated with said retaining snap.

3. The washing machine of claim 2, wherein said retaining snap includes a retaining extension that extends along a surface of said housing.

4. The washing machine of claim 1, wherein said water vacuum break further comprises at least one hose connection extending through said outer wall.

5. The washing machine of claim 4, wherein said water vacuum break further comprises a thermal sensor in thermal connection with a surface of said water vacuum break.

6. A water vacuum break for use in a washing machine having a water tub and a housing with an outer wall having a plurality of slots therein, the vacuum break comprising:

at least one retaining protrusion; and at least one retaining snap associated with said at least one retaining protrusion, such that said at least one retaining protrusion extends over a portion of the outer wall and said at least one retaining snap has an edge that engages a portion of one of the plurality of slots, said at least one retaining protrusion being L-shaped extending from a surface of the water vacuum break, said at least one retaining protrusion and said at least one retaining snap associated with said at least one retaining protrusion both utilize one of the plurality of slots.

7. The water vacuum break of claim 6, wherein said at least one retaining snap includes a flexible arm associated with said retaining snap.

8. The water vacuum break of claim 7, wherein said retaining snap includes a retaining extension that extends along a surface of the housing.

9. The water vacuum break of claim 6, wherein said at least one retaining protrusion includes a first retaining protrusion and a second retaining protrusion and said at least one retaining snap includes a first retaining snap and a second retaining snap, said first retaining protrusion and said first retaining snap associated with each other and said second retaining protrusion and said second retaining snap associated with each other, the plurality of slots include a first slot and a second slot, said first retaining protrusion and said first retaining snap being associated with the first slot and said second retaining protrusion and said second retaining snap associated with the second slot.

10. The water vacuum break of claim 9, further comprising at least one hose connection extending through the outer wall.

11. The water vacuum break of claim 10, further comprising a thermal sensor in thermal connection with a surface of the water vacuum break.

* * * * *